US012324953B2

(12) United States Patent
Brunner

(10) Patent No.: US 12,324,953 B2
(45) Date of Patent: Jun. 10, 2025

(54) TREADMILL ARRANGEMENT WITH MOTION-ADAPTIVE VIRTUAL RUNNING ENVIRONMENT

(71) Applicant: Zebris Medical GmbH, Isny im Allgau (DE)

(72) Inventor: Wolfgang Brunner, Isny im Allgau (DE)

(73) Assignee: Zebris Medical GmbH, Isny im Allgau (DE)

( * ) Notice: Subject to any disclaimer, the term of this patent is extended or adjusted under 35 U.S.C. 154(b) by 410 days.

(21) Appl. No.: 17/266,831

(22) PCT Filed: Jul. 30, 2019

(86) PCT No.: PCT/DE2019/100696
§ 371 (c)(1),
(2) Date: Feb. 8, 2021

(87) PCT Pub. No.: WO2020/035106
PCT Pub. Date: Feb. 20, 2020

(65) Prior Publication Data

US 2021/0346754 A1 Nov. 11, 2021

(30) Foreign Application Priority Data

Aug. 13, 2018 (DE) ..... 202018104636.5

(51) Int. Cl.
*A63B 22/02* (2006.01)
*A63B 21/16* (2006.01)
(Continued)

(52) U.S. Cl.
CPC ..... *A63B 22/0235* (2013.01); *A63B 21/1609* (2015.10); *A63B 22/0207* (2015.10);
(Continued)

(58) Field of Classification Search
None
See application file for complete search history.

(56) References Cited

U.S. PATENT DOCUMENTS 5,690,587 A 11/1997 Gruenangerl
6,010,465 A 1/2000 Nasher
(Continued)

FOREIGN PATENT DOCUMENTS

DE 4027317 12/1991
DE 102010004504 7/2011
(Continued)

OTHER PUBLICATIONS

Kram, R, et al., "A treadmill mounted force platform", Americal Physiological Society 67 (4), pp. 1692 to 1698, 1989.

*Primary Examiner* — Shila Jalalzadeh Abyaneh
(74) *Attorney, Agent, or Firm* — Volpe Koenig

(57) ABSTRACT

A treadmill arrangement, having a treadmill stand and an endless belt which runs over rollers mounted in the treadmill stand and is driven by a drive, with one surface of the endless belt serving as a walking or running surface. A motion state detection device is allocated to the treadmill to detect a motion state or a positional change of the legs and/or feet of the user relative to the treadmill stand and to obtain a control signal for the drive.

4 Claims, 5 Drawing Sheets

(51) Int. Cl.

| | |
|---|---|
| ***A63B 22/00*** | (2006.01) |
| ***A63B 24/00*** | (2006.01) |
| ***A63B 71/00*** | (2006.01) |
| ***A63B 71/06*** | (2006.01) |

(52) U.S. Cl.

CPC ..... *A63B 24/0087* (2013.01); *A63B 71/0622* (2013.01); *A63B 2022/0094* (2013.01); *A63B 2024/0093* (2013.01); *A63B 2024/0096* (2013.01); *A63B 2071/0081* (2013.01); *A63B 2071/0627* (2013.01); *A63B 2071/063* (2013.01); *A63B 2071/065* (2013.01); *A63B 2071/0655* (2013.01); *A63B 2208/0204* (2013.01); *A63B 2208/0233* (2013.01); *A63B 2220/13* (2013.01); *A63B 2220/30* (2013.01); *A63B 2220/52* (2013.01); *A63B 2220/58* (2013.01); *A63B 2220/801* (2013.01); *A63B 2220/806* (2013.01); *A63B 2220/807* (2013.01); *A63B 2220/833* (2013.01)

(56) References Cited

U.S. PATENT DOCUMENTS

| | | | | |
|---|---|---|---|---|
| 2008/0032871 | A1* | 2/2008 | Yeh | A63B 22/001 482/8 |
| 2009/0036272 | A1* | 2/2009 | Yoo | A63B 22/0257 482/7 |
| 2009/0124938 | A1 | 5/2009 | Brunner | |
| 2009/0176629 | A1 | 7/2009 | Yi | |
| 2010/0210419 | A1 | 8/2010 | Park | |
| 2010/0261579 | A1* | 10/2010 | Rice | A63B 22/02 482/8 |
| 2012/0264573 | A1* | 10/2012 | Hsu | A63B 22/0235 482/54 |
| 2014/0100085 | A1 | 4/2014 | Hao | |
| 2015/0173652 | A1* | 6/2015 | Brunner | A61B 5/112 482/7 |
| 2018/0178055 | A1 | 6/2018 | Netter et al. | |

FOREIGN PATENT DOCUMENTS

| | | | | | |
|---|---|---|---|---|---|
| DE | 102010017927 | | | 10/2011 | |
| DE | 102010017927 | A1 | * | 10/2011 | A61B 5/112 |
| DE | 202015101590 | | * | 11/2015 | |
| DE | 202015101590 | U1 | * | 11/2015 | A61B 5/1038 |
| DE | 202015102320 | | | 12/2015 | |
| DE | 202015102320 | U1 | * | 12/2015 | A61B 5/1107 |
| EP | 2060229 | | | 5/2009 | |
| EP | 2915449 | | | 9/2015 | |
| EP | 3202467 | | | 8/2017 | |
| GB | 2421806 | A | * | 7/2006 | A63B 22/0242 |
| KR | 200324272 | | * | 8/2003 | |
| KR | 200324272 | Y1 | * | 8/2003 | |
| KR | 101805354 | | * | 12/2017 | |
| KR | 101805354 | B1 | * | 12/2017 | A63B 24/0087 |
| WO | WO-2004099966 | A1 | * | 11/2004 | A61M 16/0429 |
| WO | 2009051314 | | | 4/2008 | |
| WO | 2014009046 | | | 1/2014 | |

* cited by examiner

TREADMILL ARRANGEMENT WITH MOTION-ADAPTIVE VIRTUAL RUNNING ENVIRONMENT

TECHNICAL FIELD

The invention relates to a treadmill arrangement, with a treadmill frame and an endless belt running over rollers supported in the treadmill frame and driven by a drive, one surface of which serves as a walking or running surface.

BACKGROUND

Treadmill arrangements for athletic training purposes have been known for a long time in a great variety of products. Their frames are usually equipped in the front part (i.e. in front of the user in the direction of use) with a display and control panel for displaying and setting parameters and functions of the arrangement and often also for displaying body function parameters of the user.

Devices and methods for gait analysis that enable recording and analysis of gait and use a treadmill are also known. Examples are DE 40 27 317 C1 or U.S. Pat. No. 6,010,465 A. In R. Kram and A. J. Powell: "A treadmill-mounted force platform" Appl. Phys. Physiol. 67 (4): 1692-1698 (1989) a measuring device is described as known, in which a treadmill is pulled over a measuring platform or measuring surface and thus a continuous recording of forces exerted by the feet of a test person on the ground is possible.

DE 10 2010 004 504.7 discloses a treadmill arrangement that is controlled according to the actual gait behavior of a user, especially a rehabilitation patient, and in which, among other things, a shutdown process can be triggered. WO 2014/009046 A2, which can be tracked back to the applicant, discloses a treadmill arrangement and a method for operating such arrangement, wherein grab handles are provided on both sides of the treadmill and a force sensor system is provided for registering and evaluating holding forces introduced into the grab handles by the user. By evaluating these holding forces, a safety shutdown of the treadmill can be controlled; however, a more complex evaluation and the actuation of certain functions of the treadmill arrangement are also possible.

From DE 20 2015 101 590 U1 of the applicant, a treadmill arrangement is known which comprises arm supports and/or a seat and in which means are provided for detecting a supporting and/or holding force or force acting on the seat for obtaining a control signal for the drive.

In another similar arrangement, described in detail in the applicant's DE 20 2015 102 320 U1, camera monitoring of the user is provided for even more reliable detection of his condition and additional utilization of signals from a foot force sensor system under the treadmill.

SUMMARY

The invention is based on the object of providing a further improved arrangement of the type mentioned, which is particularly for rehabilitation purposes and for use in the workplace, especially in the office area. One objective is to further develop the system into an even more widely usable therapeutic device and training device while further increasing safety and user acceptance.

This object is solved by an arrangement having one or more features as disclosed herein. Expedient further developments of the idea of the invention are also described below and in the claims.

The invention is based on the idea that spontaneous changes in the user's state of motion are to be expected, especially in the field of rehabilitation, and that these should be taken into account when controlling the drive in order to avoid dangerous situations. It further includes the idea of not relying on control processes actively performed by the user (as in DE 20 2015 101 590 U1), but on detecting the movement state (or changes in it) on the user's legs.

This offers increased safety, especially for patients with prolonged reaction times or overall reduced responsiveness or motor disorders of the arms/hands. Overall, this extends the range of application of treadmill arrangements for rehabilitation purposes and in the office area and makes practical use easier and safer.

Particularly advantageous in an important embodiment is the automatic recognition of the user's intention to sit or lean down before a sensor system built into the seat or backrest can detect an actual sitting or leaning down. This enables a smoother and thus for the user not only safer but also more comfortable adjustment of the belt run and thus also leads to a higher user acceptance, which additionally improves the market prospects of a corresponding treadmill arrangement—in addition to the extended field of application. This also applies to an application in the working world, especially in the office area, where potential users are often mentally occupied with other things and the intention to lean or sit down is sometimes not even fully conscious to them. In such situations, active actuators are useless for controlling belt travel.

According to one aspect of the invention, for the desired early detection of an intended leaning or sitting down, the fact is exploited that the user immediately beforehand the changes from the movement state running or walking to the state standing and thereupon is pulled back a bit by the treadmill. As a result of the change in movement state, the user's position relative to the treadmill frame changes, and this change of position can be detected by a suitable sensor system and provide the desired control signal for the drive of the treadmill. The same applies to the reverse process, i.e. when the user releases himself from the backrest or rises from the seat and in doing so also changes his position relative to the treadmill frame.

Accordingly, in an expedient embodiment of the invention, a drive control device is provided which is connected on the input side to the motion state detection device and is designed such that when a change in motion state from running or walking to standing or a change in location to the rear is detected, the belt speed is reduced or the endless belt is stopped. Furthermore, the drive control device is preferably connected on the input side to the motion state detection device and is designed in such a way that the belt speed is increased or the endless belt is started when a change in movement state from sitting or standing to running or walking or a change in location to the front is detected.

In a further embodiment, the drive control device is designed in such a way that the belt speed is increased or the endless belt is started even when leg movements of the user are detected in the seated state. In this way, "training" or belt-assisted movement of the legs (to counteract the risk of thrombosis, for example) is made possible while the user is seated.

In a further preferred embodiment, the treadmill arrangement comprises an image display device for visual representation of a virtual running environment for displaying virtual running environments, in particular equipped at least with a text/number display. The image display device is connected via a synchronization input to the motion state detection device or the control signals of the belt running speed. The term "image display device" is to be understood here in a general sense, including both a screen placed in the user's field of view and a projection surface, such as an opposite wall or on the treadmill itself, with an associated projector (such as a laser beamer). It is understood that such image display device within the meaning of the present application includes means for generating a moving image reproduction control means for controlling the reproduction of the generated image as a function of synchronization signals received via the synchronization input and thus the speed of the belt run.

In a preferred embodiment, the virtual walking environment contains instructions that prompt the user to slow down or stop the belt run by pedaling movements. The instructions for action can be given by text overlay or by pictorial representations. This can be, for example, the red or green light signal of a traffic light or virtual objects on the sidewalk.

The visual instructions for action can be supplemented by acoustic and/or haptic signals if necessary.

According to the above explanations, the motion state detection device is designed in particular to detect at least one time-dependent sensor signal and to discriminate between a sensor signal that changes in time, in particular approximately periodically, and a sensor signal that is constant or disappears in time. Thus, fluctuating sensor signals, in particular those occurring rhythmically according to leg movements during walking or running, are distinguished from approximately constant (or disappearing) sensor signals, such as occur with a standing test person or when the test person stands and is pulled away from the detection range of a sensor by the endless belt. Such a discrimination of temporally fluctuating from temporally constant sensor signals is a routine task of numerous sensor systems and can be solved by the skilled person without further description and without inventive effort.

In one embodiment of the arrangement according to the invention, a holding frame extending transversely to the treadmill, in particular adjustable, is provided in the rear part of the treadmill frame and supports the seat and/or the backrest. Such a holding frame can in particular be designed in such a way that it safely prevents a tilting to the rear and thus a dangerous fall of the user even in the case of a movement disorder.

In a further embodiment, the rear part accommodating the seat or the backrest, in particular with the holding frame, is designed separately from a main treadmill frame and in particular is detachably connected to it. This also allows conventional treadmills to be equipped with a seat or backrest option, thus extending their range of use and increasing their user-friendliness.

In the design of the sensor system belonging to the motion state detection device, there are numerous options that enable the realization of both low-cost and high-end products and the adaptation to different purposes, from low-cost home office treadmills to high-quality therapy devices with extensive rehabilitation programs. In one such embodiment, the motion state detection device comprises at least one photoelectric barrier or camera device disposed above the walking or running surface and in front of the seat or backrest for optically detecting movements of the user's legs.

In a further embodiment of the motion state detection device, it comprises a foot contact sensor system, which in particular comprises a plurality of pressure sensors arranged in a row or matrix, for determining a foot pressure distribution on the endless belt or a measuring plate located underneath it, a foot pressure evaluation unit connected to the foot sensor system on the input side, which detects the position of pressure distribution images of a walking or running user on the belt and thus their time-dependent changes in location, and a processing unit, which is connected to the output side to the foot pressure evaluation unit and which generates a detection signal from the time/place dependence of the pressure signals, which detection signal makes it possible to distinguish between walking or running from sitting or standing of the user.

In another simple implementation in terms of design and signal processing electronics, the motion state detection device has a sensor system that is placed on or under the walking or running plate below the endless belt and is designed in such a way that it detects force effects or vibrations on the walking plate in a time-resolved manner and uses this to detect a change in movement state from walking or running to sitting or standing or vice versa. For this purpose, load detection cells can be placed under the walking plate or vibration sensors can be mounted on or under the walking plate.

In another implementation that is simple in terms of design and signal processing electronics, the motion state detection device has strain gauge sensor technology that is placed on, on or under the measuring plate below the endless belt and is designed in such a way that strains and bends of the walking plate are detected in a time-resolved manner and a change in motion state from walking or running to sitting or standing or vice versa is detected from this.

In another implementation that is simple in terms of design and signal processing electronics, the motion state detection device has sensor technology, which records the power or current consumption or the speed of the drive motor for the endless belt in a time-resolved manner and uses this to detect a change in the state of motion from walking or running to sitting or standing or vice versa. This makes use of the fact that there is frictional resistance between the running belt and the measuring plate during walking, which leads to a different power or current consumption of the drive motor. Furthermore, the speed of the motor can be measured and thus a change in the state of motion can be detected.

In further embodiments, the pressure on the running belt can be measured and from this a change in movement state from walking or running to sitting or standing or vice versa can be detected.

In a further embodiment, in addition to the motion state detection device, a seat/backrest force contact detection device is provided in or on the seat and/or backrest, which generates a further control signal for the drive when it detects that the user is sitting or leaning against the backrest. Hereby, for example, the option mentioned further above can be realized, that the user also "runs" when in the seated state, or a useful redundancy can be realized in the control of the belt run. In particular, the drive control device for combined processing of the output signals of the motion state detection device and the seat/backrest contact detection device can be designed in such a way that the belt speed is reduced when a change in the movement state from walking/running to standing is detected, but the endless belt is only stopped when it is additionally detected that the user is sitting or leaning.

In a further embodiment, the treadmill arrangement comprises a user guidance unit connected at least indirectly on the input side to the motion state detection device for the optical and/or acoustic output of information or instructions for action, in particular via earphones or loudspeakers and/or as text overlays by the image display device mentioned further above. The user guidance unit is designed in such a way that its outputs are dependent on input signals supplied by the motion state detection device and optionally also by the seat/backrest force/contact detection device mentioned further above. Herewith, for example, a change of the belt speed or a stop of the belt or a restart or an increase of the belt speed can be visually or acoustically communicated to the user. He can react to this more quickly or more appropriately if, for example, the change in the belt run does not correspond to his actual wishes.

BRIEF DESCRIPTION OF DRAWINGS

Advantages and expedients of the invention are incidentally apparent from the following description of preferred embodiments based on the figures.

DETAILED DESCRIPTION

Figure 1:
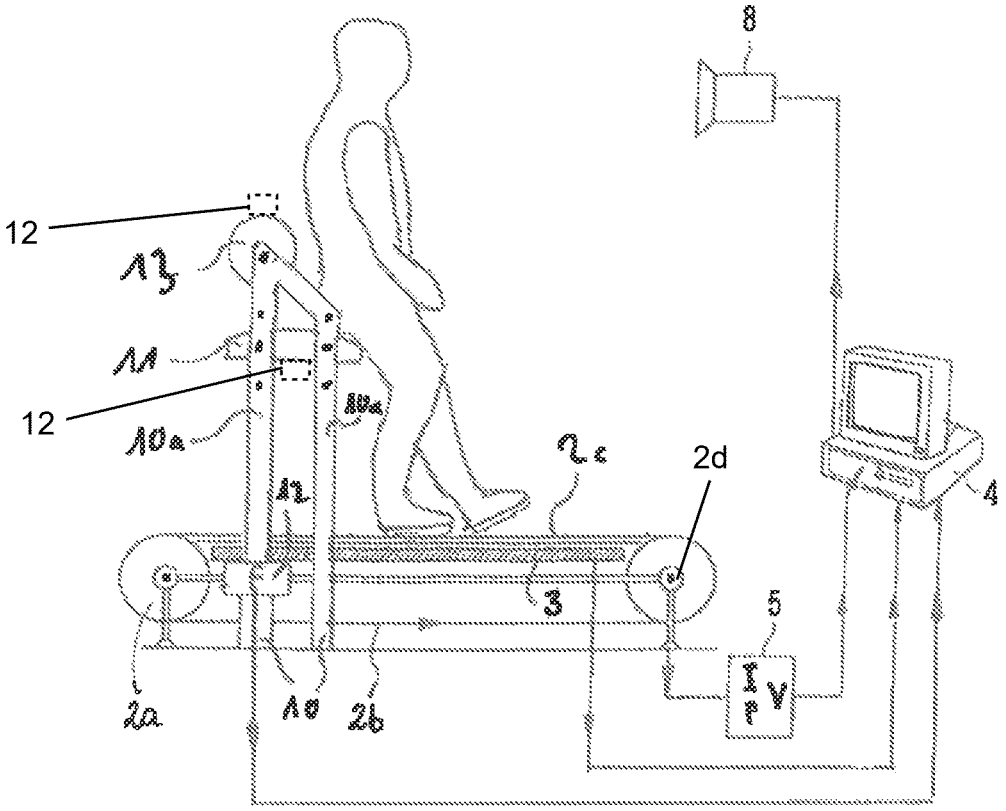
FIG. 1 is a schematic representation of a first embodiment of the invention.

FIG. 1 shows a treadmill training system 1 comprising a treadmill 2*b* running over two rollers 2*a*, under the upper surface of which, used by the user as a running surface 2*c*, a running and measuring plate 3 is arranged, which is provided with a plurality of pressure sensors (not individually designated) arranged in a row or matrix for detecting local pressure value images generated by the user when stepping the treadmill belt. One of the two rollers 2*a* is driven by a drive 2*d* and pulls the belt 2*b* at a predetermined speed set by a processing and control unit 4 of the arrangement.

To extend a user interface, an audio stage 8 (symbolized here as a loudspeaker) is provided, via which the trainee can receive additional acoustic training instructions. The audio stage 8 can also be designed bidirectionally as a headset, for example, so that the trainee can also provide acoustic feedback (such as confirmation of instructions received or answers to questions posed to him).

The pressure sensors of running plate 3 can either have an analog response characteristic or, in a simplified and less expensive version, a digital response characteristic (off/on characteristic). Both variations have merit for certain applications, and selection of one will be made by the system designer based on primary application requirements. In a simplified embodiment of the arrangement, foot contact detection can be provided by a few spaced-apart force sensors under the belt, or by strain gauges or vibration sensors in the belt or under the belt. Based on the time-dependent signals obtained with such individual sensors, a distinction can be made between rhythmic movements of the feet (running or walking) and an unmoving state of the feet (standing) and thus the desired movement state detection can be realized. In the following as well as in the claims, the term "foot touchdown sensor system" is to be understood in particular as such a simplified configuration.

A frame 10 of the treadmill assembly 1, in which the rollers 2*a* of the treadmill are mounted, has vertically projecting side parts 10*a*, in which a height-adjustable seat 11 and/or a backrest 13 is attached on both sides of the belt, against which the user can support himself when using the treadmill arrangement.

A force sensor system 12 is assigned to one or more side part(s) 10*a*. Output signals of this force sensor system, with which forces introduced by the user when leaning on the seat can be detected depending on the spatial direction, reach the evaluation computer 4, as do the signals of the instrumented running plate 3 and/or the motor measuring unit 5, in order to be processed there in a manner which is not of further interest here. In the context of the present invention, it is important that the force sensor 12 makes it possible to detect whether the user is sitting down on the seat surface 11 or leaning against the backrest 13 or is walking or running on the treadmill without contact therewith. Together with the signals of the instrumented running plate 3 ("foot touchdown sensor system"), the exemplary arrangement thus enables differentiated and, if necessary, redundant detection of changes in the user's state of motion and correspondingly reliable and gentle control of the belt run.

The treadmill arrangement sketched in FIG. 1 represents a high-end configuration from which various components and functions can be omitted or modified without deviating from the inventive concept. Thus, the invention can also be advantageously used with a treadmill arrangement without acoustic user guidance and thus also without the corresponding evaluation and processing components.

As mentioned further above, instead of a pressure or strain sensor system, an optical sensor system in the form of a photoelectric barrier or camera with a corresponding evaluation device can also serve as a motion state detection device. Such a photoelectric barrier device, e.g. a photoelectric barrier array, can for example be placed and configured in such a way that it simply detects a change in position of the user relative to the treadmill frame (i.e. the mentioned pulling backwards when standing still). In a more elaborate embodiment, a photoelectric array may be placed above the treadmill in the area of the user's feet or lower legs and discriminate the photoelectric signals that are rhythmically interrupted when running or walking from a constant signal generated when the user is standing.

Furthermore, the motion state detection device can continuously detect the motor characteristics such as power consumption, current or motor speed.

Figure 2:
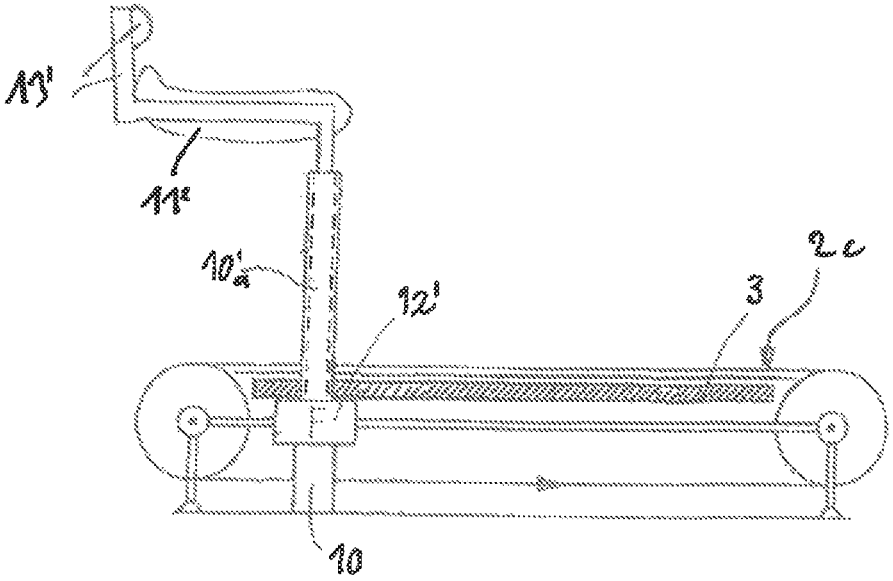
FIG. 2 is a schematic cutaway view of a second embodiment of the invention.

FIG. 2 shows a modification of the arrangement shown in FIG. 1 and described above. Insofar as the same components are used here as in that arrangement, they are designated with the same reference numbers as in FIG. 1 and are not explained again.

In a modification of the armrest configuration shown in FIG. 1 and described above, the seat 11' and the backrest 13' are supported only by a side part 10*a*'. Associated with the seat 11' is a seat force sensor system 12' for controlling treadmill parameters or functions, specifically for braking or accelerating the belt, is assigned to the seat 11'. The output signals of both the foot contact sensor system of running plate 3 and the seat seat force sensor system 12' reach the processing and control unit 4.

The seat force sensor system 12', which in this case is integrated in the lower portion of the treadmill frame 10, detects force components acting on the seat, in particular sitting down or lifting up, and possibly also tilting forward or backward. Depending on the type of sensor used and the downstream evaluation, this detection is used in particular for effecting a speed change or emergency shutdown or also for a restart of the treadmill.

Instead of the arrangement of the force sensor system 12, for a user leaning against the backrest 13 or a user sitting on the seat 11 at the foot of a corresponding holder or side part in the treadmill frame, the force sensor system 12 having a pressure sensor or (better) an arrangement of several pressure sensors or a simple contact sensor mat can also be integrated in the backrest or the seat itself. In principle, optical detection of whether the user is touching the seat or backrest is also feasible. The force sensor(s)/force sensor system 12 can be accommodated in any area of the projecting side parts 10*a*, i.e. also in an upper area.

Figure 3:
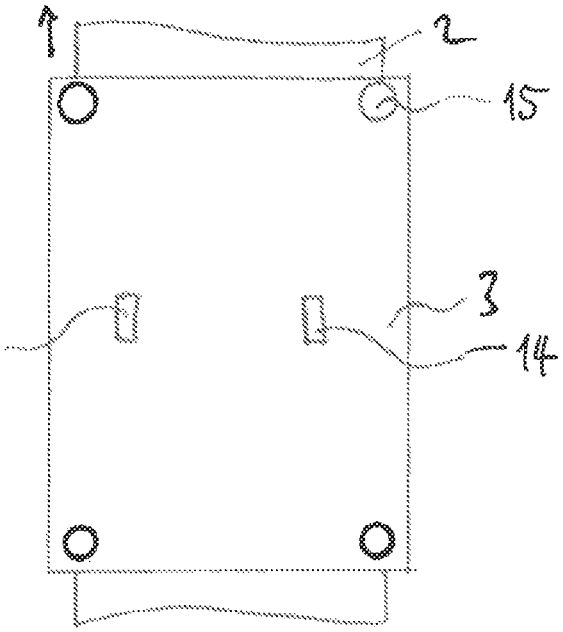
FIG. 3 is a synoptic sketch-like representation of further embodiments of an instrumented running plate.

FIG. 3 shows a running or measuring plate 3 from below. In operation, the endless belt 2*b* is pulled over the top of the measuring plate 3. A particularly preferred arrangement of strain gauges 14 is provided here, which are firmly connected to the left and right sides of the measuring plate and can thus measure the strain of the running plate. The arrangement has the particular advantage that it can distinguish between the left and right foot and thus the state of movement can be detected more reliably. In a further embodiment, several strain gauges can be arranged along the running plate in pairs but also individually. As an alternative, FIG. 3 shows a possible arrangement of load detection cells 15.

Figure 4:
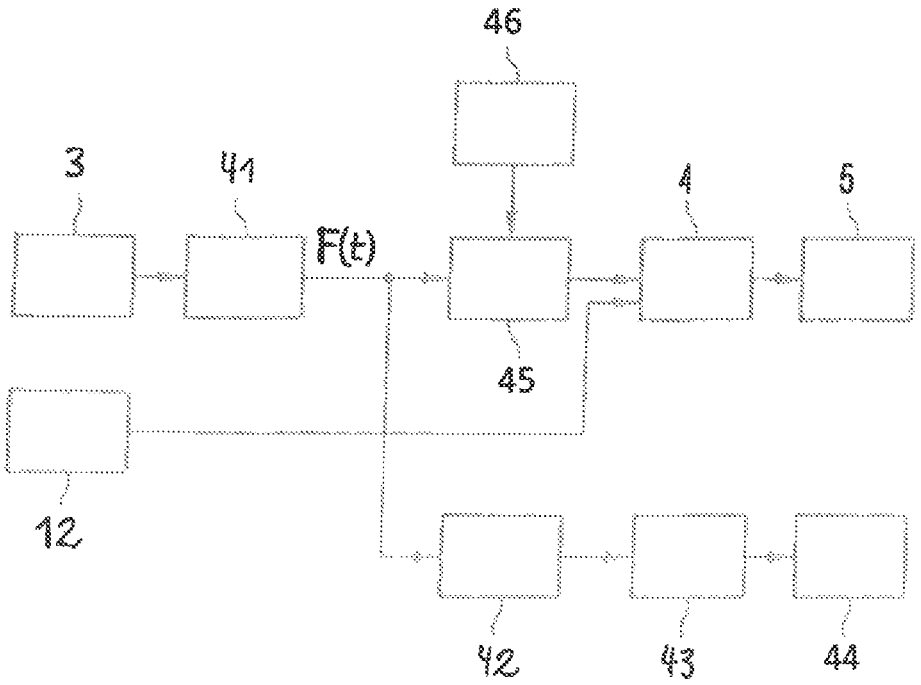
FIG. 4 is a block diagram of a further embodiment.

FIG. 4 shows a schematic partial view in the form of a functional block diagram of essential components or aspects of the evaluation and control component of a further embodiment of the treadmill arrangement. Partially reference is made to components and functions shown in FIGS. 1 and 2 and explained in principle above.

On the output side, the foot contact sensor system of running plate 3 is connected to a preprocessing stage 41, at the output of which interference-free, time-dependent signals F(t) are output. This preprocessed signal then passes via a synchronization stage 42 to a gait characteristic evaluation stage 43, which makes a gait characteristic of the user determined on the basis of the measurement signals or essential parameters of such a characteristic available to an evaluation computer 44 of the doctor or physiotherapist.

On the other hand, the preprocessing stage 41 is connected to a time dependency comparison unit 45, in which the foot force recorded in a time-resolved manner is continuously compared with comparison data or comparison patterns stored in a comparison pattern memory 46. The comparison data/patterns represent typical time dependencies corresponding to a running or walking of the user on the belt surface or, on the other hand, to an almost motionless standing, and allow an assignment of the currently recorded signals to one of the basic motion states "running/walking" or "standing/sitting".

As a result, at the output of the comparator unit 45, a first input signal is provided to the processing and control unit 4 of the treadmill arrangement, the output signal of which here reaches the motor measuring unit 5, having a speed controller. In the embodiment shown, a signal originating from the force sensor system 12 arranged on the backrest 13 (or the seat force sensor system 12' assigned to the seat 11') also reaches the processing and control unit 4 and is processed there in addition to the foot touchdown signal, as a second input signal, to obtain a control signal for the treadmill operation.

Depending on the motion state detection, speed changes of the treadmill can thus be controlled, if necessary up to shutdown (standstill). The belt run can also be prevented from starting as long as it is not ensured that the user actually releases himself from the backrest. This control sequence is largely independent of the user's will and is based on the user's actual movement sequence.

The embodiment of the invention is not limited to these examples, but is equally possible in a variety of variations which are within the scope of skilled practice.

Figure 5:
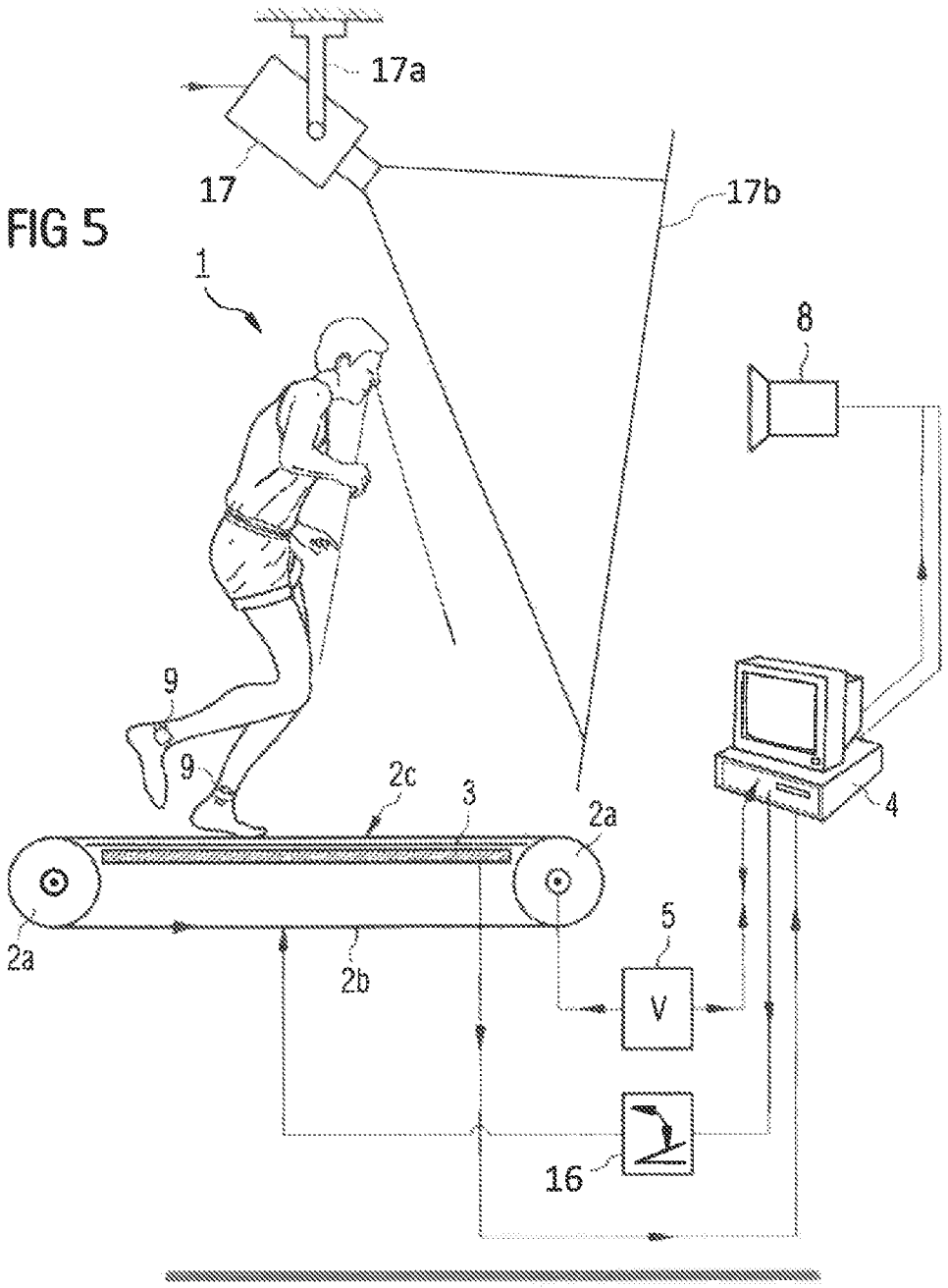
FIG. 5 is a schematic representation of an embodiment of the invention with image display device and FIG. 6 is a detailed view of the latter embodiment as a block diagram.

FIG. 5 shows a treadmill training system 1 which has the same basic components such as the treadmill training system of FIG. 1, and in this respect is not described further here. In addition to the system shown there, an inclination of the entire treadmill can be adjusted as required (which is only shown symbolically in the figure) via a suitable inclination actuator 16, which can also receive interference signals from the processing and control unit 4, or optionally only its front part can be raised somewhat.

In the very simplified version shown in FIG. 5, signals characterizing the set speed value of the belt are sent back from the speed controller of motor measuring unit 5 to the processing and control unit 4, where they are used to synchronize an image display on the running surface 2*c* by means of a projector (laser beamer) 17. The display content is generated from pre-stored image elements and/or image sequences (cf. further below) and advantageously offers the user a motivating virtual running environment in which training-related instructions and/or data can be superimposed.

The visual representation is controlled here by way of example on the basis of the speed signals in such a way that—in particular in conjunction with a special embodiment described further below—the user is presented with a overall coherent simulation of a running environment, advantageously linked to the simulation of obstacles to be overcome or avoided. Deviating from the representation in the figure, the actual speed of the belt can also be detected via a suitable sensor system (not shown) and the measured value can be fed to the processing and control unit 4 for the purpose of (to a certain extent feedback) sequence control of the image representation and synchronized evaluation of the pressure distribution patterns. It is expressly pointed out that the synchronization and thus sequence control of the image display by means of the projector 17 serving as an image display device can be carried out with signals of the other sensors mentioned above as well as combinations of such sensor signals.

In the figure, it is shown that the projector 17 is attached to a ceiling mount 17*a* in an angle-adjustable manner so that the projection direction can be modified to a flat or preferably curved projection surface 17*b* arranged in front of the user. Incidentally, an audio stage 8 is also provided here, via which the user can receive additional acoustic training instructions. The audio stage 8 can, for example, also be designed bidirectionally as a headset, so that the trainee can also provide acoustic feedback (such as confirmation of instructions received or answers to questions posed to him).

In order to perform training tasks on the treadmill system, it may be of interest to detect the height at which the feet are lifted off the belt, e.g. when the test person is to cross a virtual obstacle. Therefore, in a further embodiment, the trainee has a sensor 9 attached to each foot, the signals from which can be detected by means of a position detection sensor system known per se (not shown here) to provide conclusions about the position or height of the feet. The sensors preferably operate in time synchronization with the sensors of the pressure distribution matrix. Precise time synchronization can be established, if necessary, via an infrared or radio signal or via detection of the time of occurrence.

The sensors 9 can be embodied as acceleration sensors or multi-axis acceleration sensors and may be connected to the processing and control unit 4 via radio. The position of the feet can be calculated from the acceleration signals, particularly if the time and location dependence of the pressure distribution patterns can also be included in the calculation. In extended arrangements, inertial sensor systems can be used in which gyroscopes or sensors for detecting the earth's magnetic field are also employed. Such sensors can, of course, also be attached to other parts of the body so that the movement of the complete lower extremities or the entire body can be measured and displayed. However, the sensors 9 can also operate according to other measurement principles, for example on the basis of active or passive light markers picked up by stationary cameras, magnetic field sensors or ultrasonic sensors that emit or receive ultrasonic waves to or from stationary receivers and determine the position of the feet from the transit time of the sound.

The pressure sensors of the measuring plate can have either an analog characteristic or, in a simplified and less expensive version, a digital response characteristic (off/on characteristics). Both variants have their justification for certain applications, and the selection of one of the variants will be made by the system designer according to the primary application requirements.

Figure 6:
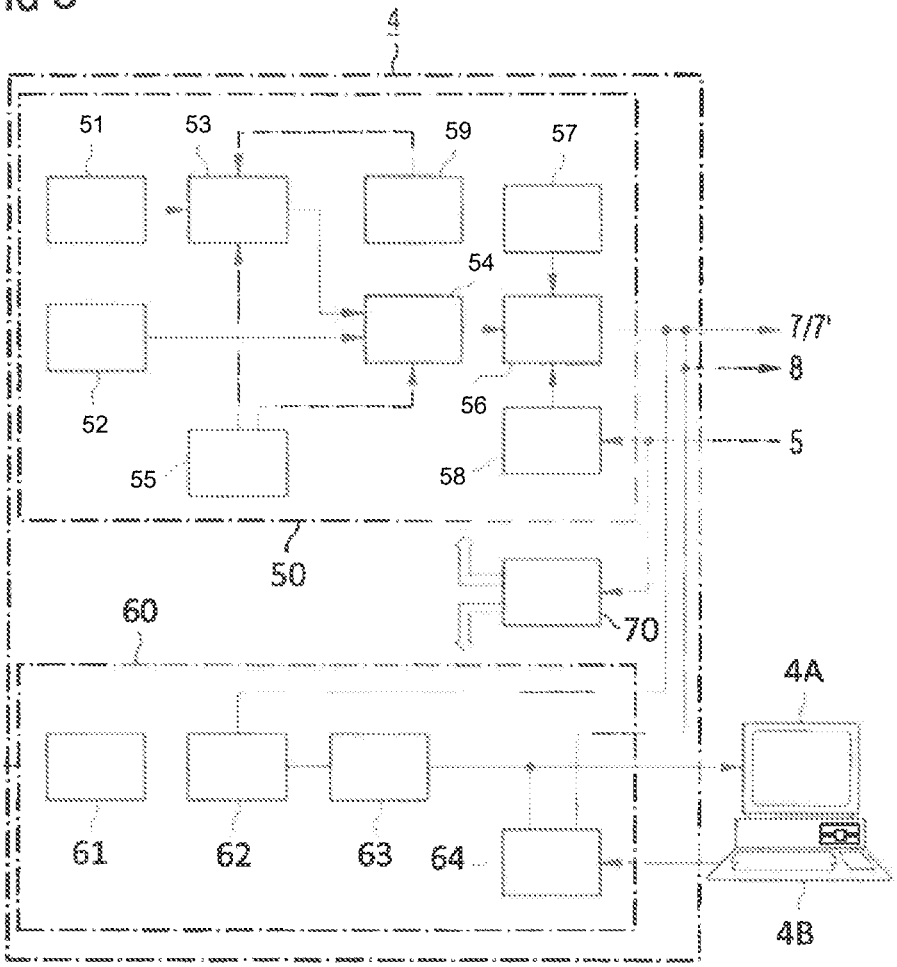

FIG. 6 shows a detailed representation of the main components of the processing and control unit 4 of the arrangement shown in FIG. 5. Excluded here is the image signal equalizer shown separately in FIG. 5, which is also only used in a version of the arrangement with the projector directed obliquely at the treadmill.

In the processing and control unit 4, a display control section 50 comprises a picture element storage unit 51 and a video memory 52, downstream of which a picture element mixer 53 and finally a video picture element mixer 54 are connected for generating picture sequences with predetermined picture element insertions. It is also shown symbolically that both mixers 53, 54 can also be influenced by control signals from a random generator 55. The second mixer 54 is also followed by a display sequence controller 56, to which a sequence program memory 57 and a speed controller 58 are assigned. A picture element position controller 59 is connected to the picture element mixer 53 by control signals and acts on it to vary relative positions of picture elements in the final display. The speed controller 58 can be influenced by signals from the speed controller of the motor measuring unit 5 of the treadmill (not shown in this figure) or another sensor of the motion state detection device explained further above.

At the same time, these signals are fed to a system control unit 70 of the arrangement, which synchronizes the various control operations of the display and evaluation functions and carries out any necessary adjustments to the data streams and formats. This is symbolized in the figure by double arrows directed at the display control section 50 and the evaluation section 60.

The evaluation section 60 also receives the final image signal provided at the output of the display sequence controller and, on the other hand, the (spatiotemporally resolved) output signal of the print distribution plate 3. The latter signal is made free of interference signals and artifacts in a pressure signal preprocessing stage 61, brought into temporal synchronism with the image signals in a pressure signal time adjustment stage 62 and into spatial synchronism with the image signals in a pressure signal position adjustment stage 63, and processed in a training evaluation stage (main processing stage) 64 on the basis of a predetermined training evaluation program, and the results are output to a separate display unit 4A of the therapist. They can also be processed—together instructions input via an input unit 4B of the therapist—in a user guidance stage 54 into instructions to the trainee, which are output via the display unit 7 or 7' assigned to the latter and optionally the audio stage 8.

In the context of the present invention, the operation of these functional units of the treadmill arrangement is ultimately controlled by signals from the motion state detection device and thus adapted to the actual motion state of the user of the treadmill arrangement. In particular, this involves synchronizing the display of a virtual environment with the actual movements of the user. Furthermore, the output of training instructions or of information on the movement state or physical condition of the user can also be synchronized accordingly, thereby creating a more realistic training environment overall. This, in turn, on the one hand avoids possible irritation of the user by an "inappropriate" training environment, and on the other hand improves his motivation to complete the training or rehabilitation program.

Carrying out the invention is not limited to the aspects highlighted and examples explained above, but is equally possible in a variety of variations which are within the scope of skilled practice.

The invention claimed is:

1. A treadmill arrangement, comprising:

a treadmill frame;

an endless belt running over rollers supported in the treadmill frame and driven by a drive, one surface of the endless belt serving as a walking or running surface;

at least one of a seat or a backrest attached to projecting side parts or a rear part of the treadmill frame;

a processing and control unit, connected to the drive, configured to distinguish walking or running from sitting or standing and vice versa, and in response thereto, control the drive;

a motion state detection device connected to the processing and control unit, the motion state detection device configured to (i) detect a motion state of a user on the endless belt, by detecting at least one time-dependent sensor signal and discriminating between a time-varying and a time-constant or disappearing sensor signal, and (ii) generate a detection signal for the processing and control unit; and a seat/backrest contact detection device provided in or on the seat and/or the backrest and connected to the processing and control unit, the seat/backrest contact detection device configured to (i) detect when the user is sitting on the seat or leaning against the backrest and (ii) generate a detection signal for the processing and control unit;

wherein the processing and control unit is configured for combined processing of the detection signals from said motion state detection device and said seat/backrest contact detection device and control the drive such that:

(a) upon detecting a change in the motion state from at least one of sitting or standing to walking or running, the endless belt starts running or a running speed of the endless belt is increased, and (b) upon detecting a change in motion state from walking or running to standing, the running speed of the endless belt is reduced, and upon additionally detecting that the user is sitting on the seat or leaning against the backrest, the endless belt is stopped.

2. The treadmill arrangement of claim 1, wherein the seat/backrest contact detection device is further configured to generate a synchronization signal for an image display device upon detecting that the user is sitting on the seat or leaning against the backrest.

3. A treadmill arrangement, comprising:

a treadmill frame;

an endless belt running over rollers supported in the treadmill frame and driven by a drive, one surface of the endless belt serving as a walking or running surface;

at least one of a seat or a backrest attached to projecting side parts or a rear part of the treadmill frame;

a processing and control unit, connected to the drive, configured to distinguish walking or running from sitting or standing and vice versa, and in response thereto, control the drive;

a motion state detection device connected to the processing and control unit, the motion state detection device configured to (i) detect a motion state of a user on the endless belt, and (ii) generate a detection signal for the processing and control unit;

a seat/backrest contact detection device provided in or on the seat and/or the backrest and connected to the processing and control unit, the seat/backrest contact detection device configured to (i) detect when the user is sitting on the seat or leaning against the backrest and (ii) generate a detection signal for the processing and control unit;

wherein the processing and control unit is configured for combined processing of the detection signals from said motion state detection device and said seat/backrest contact detection device and control the drive such that:

(a) upon detecting a change in the motion state from at least one of sitting or standing to walking or running, the endless belt starts running or a running speed of the endless belt is increased, and (b) upon detecting a change in motion state from walking or running to standing, the running speed of the endless belt is reduced, and upon additionally detecting that the user is sitting on the seat or leaning against the backrest, the endless belt is stopped.

4. The treadmill arrangement of claim 3, wherein the seat/backrest contact detection device is further configured to generate a synchronization signal for an image display device upon detecting that the user is sitting on the seat or leaning against the backrest.

* * * * *